US005340224A

United States Patent [19]

Chao

[11] Patent Number: 5,340,224

[45] Date of Patent: Aug. 23, 1994

[54] PUSH-TYPE WRITING INSTRUMENT

[76] Inventor: Wen-Kuei Chao, c/o Hung Hsing Patent Service Center P.O. Box 55-1670, Taipei (10477), Taiwan

[21] Appl. No.: 99,457

[22] Filed: Jul. 30, 1993

[51] Int. Cl.[5] ..... B43K 21/16; B43K 21/22

[52] U.S. Cl. ..... 401/65; 401/67; 401/94

[58] Field of Search ..... 401/67, 94, 65

[56] References Cited

U.S. PATENT DOCUMENTS

| | | | |
|---|---|---|---|
| 2,563,551 | 8/1951 | Refsdal | 401/65 |
| 3,583,819 | 6/1971 | Coutre | 401/67 |
| 4,844,639 | 7/1989 | Chao | 401/94 X |

FOREIGN PATENT DOCUMENTS

| | | | |
|---|---|---|---|
| 683616 | 11/1939 | Fed. Rep. of Germany | 401/67 |
| 1085793 | 7/1960 | Fed. Rep. of Germany | 401/67 |
| 904406 | 11/1945 | France | 401/67 |
| 220232 | 6/1942 | Switzerland | 401/67 |

*Primary Examiner*—Steven A. Bratlie

[57] ABSTRACT

A push-type writing instrument, particularly a pencil, includes a retaining collar downwardly protruded from a pair of radially opposed fingers provided on a tapered forward portion of an outer body in which a lead is retained, having two arm members with each arm member connected between the retaining collar and each finger for suspending the retainer collar under the pair of opposed fingers to prevent loss of resilience of the two fingers due to fatigue failure when frictionally holding the lead between the two fingers for a long time service.

1 Claim, 3 Drawing Sheets

PUSH-TYPE WRITING INSTRUMENT

BACKGROUND OF THE INVENTION

U.S. Pat. No. 4,844,639, issued to the same inventor of this application, discloses a writing instrument essentially comprising an outer body having a tapered forward portion in which a lead is retained by a pair of radially opposed fingers provided on the tapered forward portion for frictional engagement with a lead. However, since the lead 1 is movably held in between the two opposed fingers 15 of the outer body 10, the two fingers 15 after a long-time service of the writing instrument may lose their resilience due to fatigue failure, easily causing a downward slipping of the lead 1 from the two fingers due to a gravity of the lead itself when the press member 3 is downwardly depressed to release the clamping means such as the tightening ring 2 on the tapered portion 23 of the lower section 22 of the inner sleeve 20.

Meanwhile, the tightening ring 2 is reciprocatively held in the window 13 notched in the tapered forward portion 12 of the outer body 10. In order to provide an effective clamping of the lead 1 by the ring 2 and the tapered portion 23 of the inner sleeve 20, the ring 2 should have an enough length. Otherwise, a thinner ring 2 will soon be released from the tapered portion 23 to lose its clamping effect when the inner sleeve 20 is downwardly depressed, thereby being unable to clamp the lead to protrude the lead downwardly outwardly for writing use. However, if the ring 2 is made too long causing a long distance of the window 13 for the ring 2, a total length of the writing instrument will then be prolonged, possibly producing a poor appearance of the instrument.

SUMMARY OF THE INVENTION

The object of the present invention is to provide a push-type writing instrument, particularly a pencil, including a retaining collar downwardly protruded from a pair of radially opposed fingers provided on a tapered forward portion of an outer body in which a lead is retained, having two arm members with each arm member connected between the retaining collar and each said finger for suspending the retainer collar under the pair of opposed fingers to prevent loss of resilience of the two fingers due to fatigue failure when frictionally holding the lead between the two fingers for a long time.

DETAILED DESCRIPTION

Figure 1:
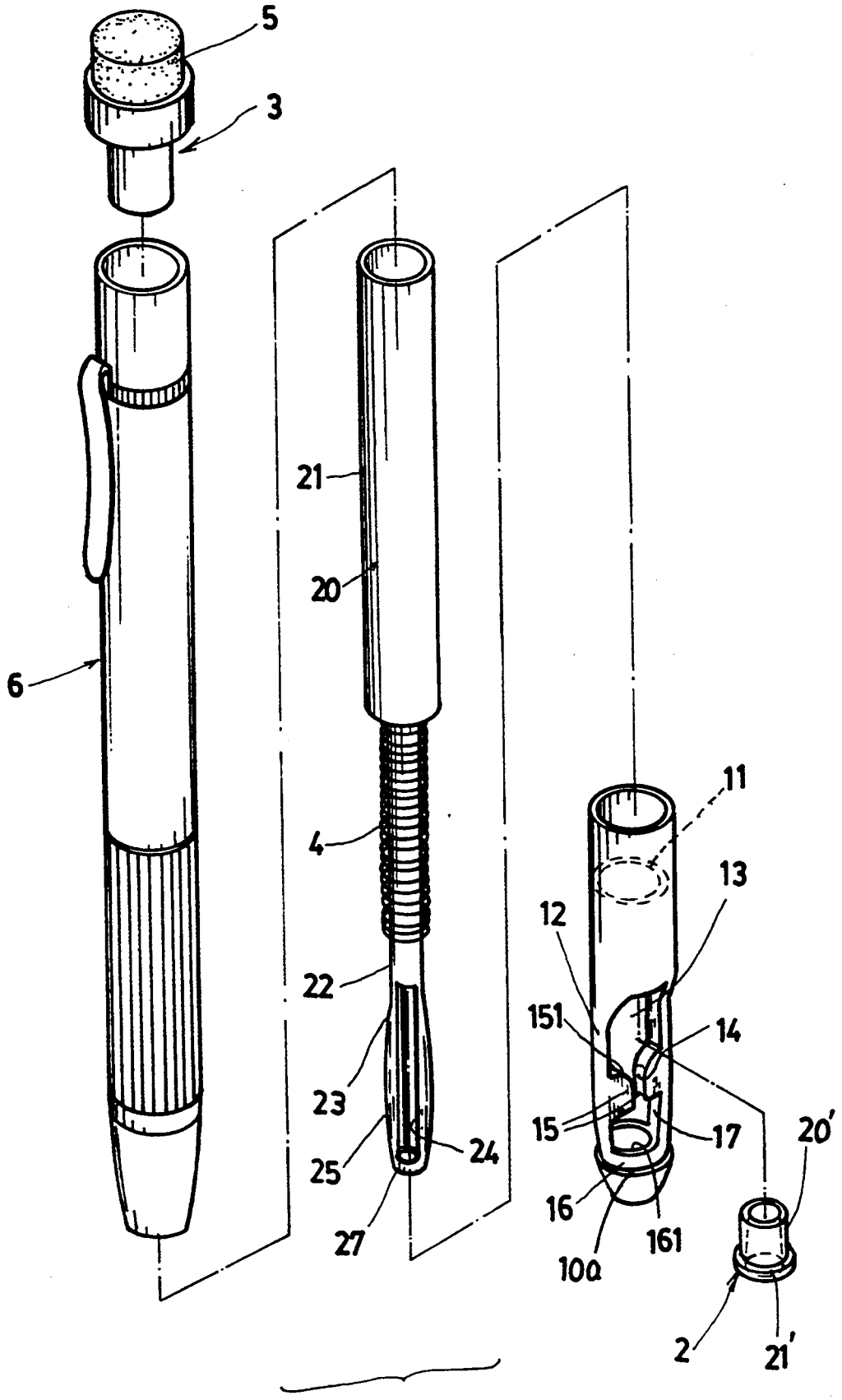
FIG. 1 is an exploded view of the present invention showing all elements in construction of the present invention.

The present invention is an improvement and modification based on U.S. Pat. No. 4,844,639 which was previously filed by the same inventor of this application. Therefore, original disclosure is incorporated herewith for reference.

In view of the basic structure of this invention, the outer tube 10 of the pencil having a cylindrical inner wall is formed with a protruded annular seat 11 and a tapered front (or forward) portion 12 which is provided with a window 13, a slit 14 and a lead 1 retaining means consisting of a pair of opposed fingers or detents 15, 15. The slit 14 is formed at the front portion of the tube 10 opening to the lower edge of the window 13 to provide said portion with a contractility to thereby facilitate insertion of a tightening ring 2 from the window 13 to the inside of the tube 10 and provision of resiliency with the lead retaining means.

The fingers 15, 15 forming the lead retaining means are diametrically and oppositely formed on the inner wall of the front portion of the tube 10.

The inner tube 20 is composed of an upper or rearward section 21 of a larger diameter and a lower (or forward) section 22 of a substantially smaller diameter. The upper section 21 is provided with an axial hole (or inner diameter) adapted for storing a plurality of leads ready for use, while the hole (or inner diameter) provided in the lower section 22 allows just a single piece of lead to pass therethrough. An intermediate section 26 has a conical opening directing the lead between the upper section 21 and the lower section 22.

The front portion of a lower section 22 of the inner tube 20 is formed with a gently tapered portion (or diameter) 23. On the diametrically opposite side walls of the tapered portion 23, there are provided with longitudinal slots 24, 24 rendering said portion a diametrically radially contractible nature and cooperatively consituting a clamping means with the aforesaid tightening ring 2. The tightening ring 2 is of a short cylindrical tube having a fairly good resiliency and preferably having a diameter slightly smaller than the outer diameter of the widest part of the tapered portion 25. Thus, the tightening ring 2 may be forcibly pushed from the front end of the tube and slidably located about the tapered portion 23. To the rear end of the inner tube, a press member (or end cap) 3 is secured between the lower end of the upper section 21 of the inner tube and the upper edge of the annular seat 11 formed on the inner wall of the outer tube 20, a spring 4 is provided about the lower section 22 of the inner tube 20 for urging the inner tube 20 to normally locate in its retracted position, i.e., writing position.

The press member 3 has an outer diameter slightly smaller than the inner diameter of the inner tube 20, and both are smaller than the inner diameter of the outer tube 10. The press member 3 may be provided with an eraser 5 and the like at its rear end as desired.

The modification of the present invention includes: a retaining collar 16 having a central hole 161 formed through the central portion of the collar 16 for free passing a lower ring member 27 formed on a lowermost end portion of the lower section 22 of the inner sleeve 20, with the collar 16 suspended under the two opposed fingers 15, 15 having a pair of arm members 17,17 each arm member connected between the retaining collar 16 and each finger 15. Since the retaining collar 16 is a closed circular ring, it will limit a laterally rightwardly and leftwardly loosening and separation of the two fingers 15, 15 to prevent a loss of resilience due to fatigue failure of the two fingers 15, 15 after long time service of the writing instrument of the present invention. For esthetic reason, the length of such a collar 16 downwardly extended from the two fingers 15 should not be too long.

Another modification of the present invention is to provide the tightening ring 2 having a flange 21' integrally secured on a forwardmost portion (or lowermost portion as shown in the figures) of a cylindrical plunger portion 20' of the tightening ring 2. The flange 21' has an outside diameter larger than an outside diameter of the cylindrical plunger portion 20' of the ring 2. The cylindrical plunger portion 20' is reciprocatively held in a plunger hole 111 formed in a central portion through an annular seat 11 formed in an inside wall of the tapered forward portion 12 of the outer body or tube 10. And the flange 21' is reciprocatively movably held in the window 13 notched in a forwardmost portion of the outer body 10, and is limited between a "retraction limiting point" on a forward side portion 112 of the annular seat 11 and a "protrusion limiting point" on a finger shoulder portion 151 recessed in a rear end portion of each said finger 15. The annular seat 11 has its rear side portion 110 for resting a forward spring end of the spring 4.

Figure 5:
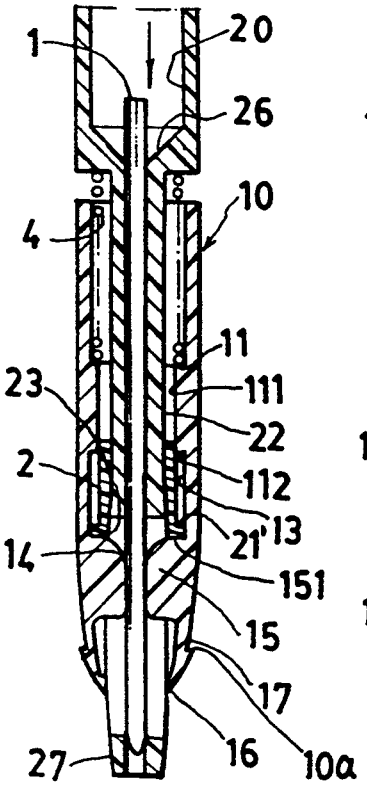
FIG. 5 shows a downwardly protruded lead when still depressing a press member of the present invention.
Figure 6:
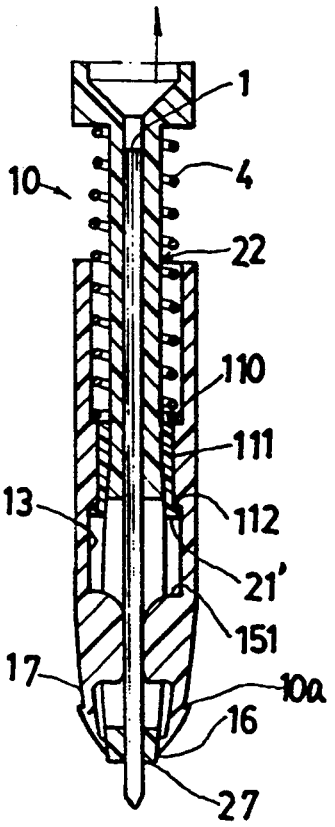
FIG. 6 shows a releasing of the press member, but an outwardly protruded lead for writing use in accordance with the present invention.

The designation of such "retraction limiting point" is made to define a rearward moving "deadpoint" of the flange 21' of the tightening ring 2 as shown in FIG. 6, and the "protrusion limiting point" is made to define a forward moving "deadpoint" of the flange 21' as shown in FIG. 5.

Since the plunger portion 20' of the ring 2 is reciprocatively held in the hole 111, and only the flange 21' of the ring 2 is slidably held in the window 13, the length of the window 13 or a moving "stroke" of the flange 21' of the ring 2 can then be shortened in comparison with a longer distance or height of the window 13 as shown in the previously filed and issued U.S. Pat. No. 4,844,639, to thereby shorten an overall length of the writing instrument of the present invention for a compact esthetic appearance.

Naturally, the flange 21' of the ring 2 may also be formed on a rear portion (not shown) of the plunger portion 20', forming a further modification of the tightening ring 2 of the present invention. The reciprocative moving direction of such a modified ring 2 will then be opposite to the moving direction of the ring 2 as abovementioned.

Figure 2:
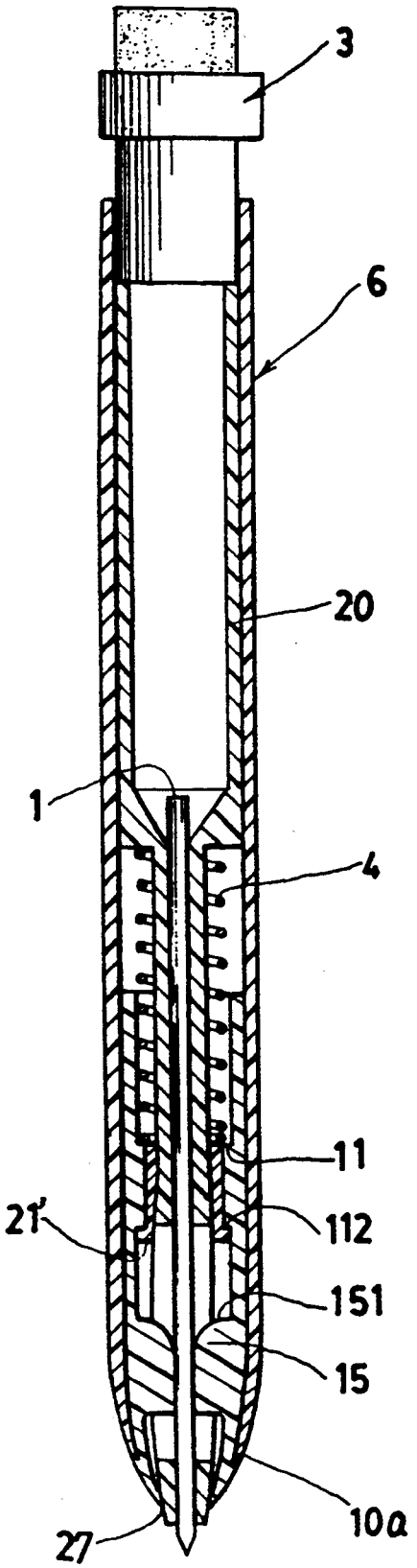
FIG. 2 is a sectional drawing of the present invention when assembled.
Figure 2A:
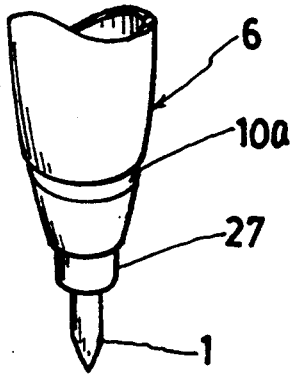
FIG. 2A shows a lower portion of the present invention when assembled.
Figure 3:
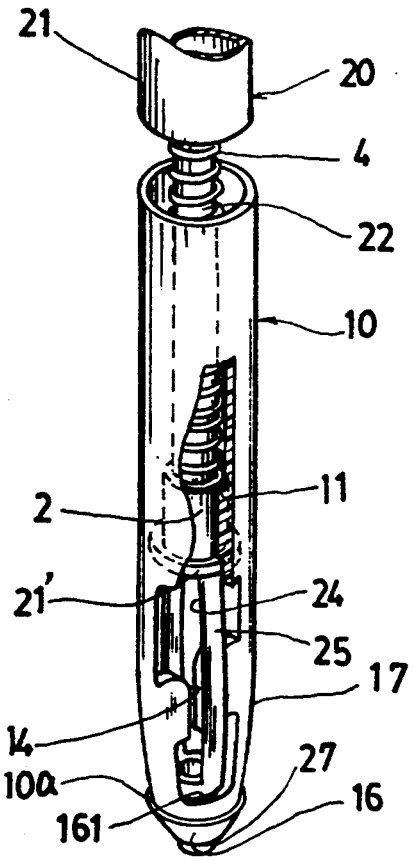
FIG. 3 is a partial cut-away illustration of the present invention.

As shown in FIGS. 1, 2, a further protective sheath 6 is provided for shielding said outer body 10 and inner sleeve 20 in said sheath 6, having a sealing enclosure (not shown) for covering the forward end portions of the outer body 10 and inner sleeve 20. A coupling hook portion **10*a* is formed on a lowest periphery of the outer body 10 to engage a lower edge portion 6*a* of the sheath 6 for coupling the sheath 6 with the outer body 10, having the inner sleeve 20 engaged in the outer body 10**.

Figure 4:
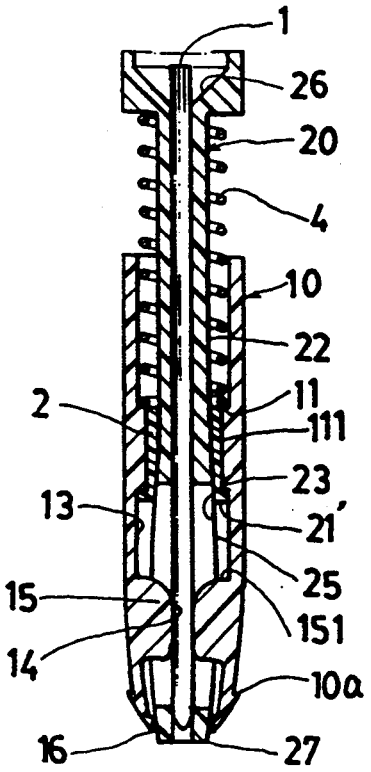
FIG. 4 is an illustration showing a first step when intended to depress the lead downwardly for writing use.

From FIGS. 4–6, the operating procedures for protruding the lead 1 outwardly for writing purpose can be seen. The retaining collar 16 as shown in the figure will protect the two fingers 15 to prevent its loosening due to fatigue failure.

I claim:

1. A push-type writing instrument comprising in combination:

an outer body comprising a sleeve having an open rearward portion and a tapered forward portion, the outer body having an inner wall provided with an internal annular seat formed therein substantially adjacent to the forward portion of the body; an inner sleeve having a forward section and a rearward section, each section having an outer diameter, the outer diameter of the forward section being reduced with respect to the outer diameter of the rearward section of the inner sleeve, such that the respective sections of the inner sleeve are joined by an intermediate section, the forward section of the inner sleeve further having an inner diameter in which a length of lead is slidably guided therein, the rearward section of the inner sleeve further has an inner diameter adapted for storing a plurality of leads, the intermediate section of the inner sleeve further having a conical opening communicating with the inner diameter of the forward section and the inner diameter of the rearward section of the inner sleeve;

a spring retained within the outer body axially between the internal annular seat thereof and the intermediate section of the inner sleeve, encircling a portion of the forward section of the inner sleeve, and thereby constantly urging the inner sleeve rearwardly of the body;

a cap means for closing the rearward open portion of the outer body and for engaging the rearward section of the inner sleeve; the inner wall of the outer body at the tapered forward portion thereof having a pair of radially opposed, axially extended fingers for frictional engagement with the lead;

the forward section of the inner sleeve having a forwardmost portion formed with a tapering diameter and provided with two opposed longitudinal slots, thereby rendering the forwardmost portion of the forward section of the inner sleeve radially contractable, the radially opposed, axially extended fingers on the tapered forward portion of the inner wall of the outer body extending through the opposed longitudinal slots on the front-most portion of the inner sleeve thereby engaging the lead, the fingers further engaging the inner sleeve thereby stopping the urging rearwardly by the spring such that the inner sleeve is retained within the outer body;

a resilient tightening ring retained within the tapered forward portion of the outer body, the resilient ring having an inner diameter, the inner diameter being reduced with respect to the tapering diameter of the forwardmost portion of the forward section of the inner sleeve, and the resilient ring being slidably guided over the tapering diameter thereby cooperating with the forwardmost radially contractable position of the inner sleeve to clamp the lead therein;

the tapered forward portion of the outer body having a slit formed between said two fingers, the forward portion of the outer body further having a window formed therein rearwardly of the slit and communicating with the slit whereby the slit provides a contractility to the forward portion of the outer body and facilitates the insertion of the resilient tightening ring through the window whereby the resilient ring may be disposed within the outer body and whereby the inner sleeve may be slidably inserted through the open rearward portion of the outer body and axially within the body such that the forwardmost portion of the inner sleeve formed with a tapering diameter is received and retained within the resilient ring; the improvement which comprises:

said pair of radially opposed fingers having a retaining collar protruding forwardly from said two opposed fingers having a central collar hole for free passing a forwardmost end portion of said inner sleeve through said central collar hole of said retaining collar, each said finger having an arm member protruding forwardly from said finger for connecting said retaining collar to each said finger to forwardly suspend said retaining collar from said two fingers, thereby limiting a lateral separation of the two said fingers for preventing a loss of resilience of the two fingers frictionally holding a lead passing therebetween due to fatigue failure.

* * * * *